US006152164A

United States Patent [19]

Whiteside

[11] Patent Number: 6,152,164

[45] Date of Patent: Nov. 28, 2000

[54] PRESSURE-DROP ACTIVATED TRAP SEAL PRIMER VALVE

[75] Inventor: Michael J. Whiteside, Toronto, Canada

[73] Assignee: MIFAB, Inc., Detroit, Mich.

[21] Appl. No.: 09/359,505

[22] Filed: Jul. 23, 1999

Related U.S. Application Data

[60] Provisional application No. 60/105,311, Oct. 23, 1998.

[51] Int. Cl.[7] ..... F16K 13/10; F16L 55/24

[52] U.S. Cl. ..... 137/247.25; 137/118.05

[58] Field of Search ..... 137/247.25, 118.05, 137/115.06

[56] References Cited

U.S. PATENT DOCUMENTS

| | | | |
|---|---|---|---|
| 2,233,818 | 3/1941 | Matter | 137/118.05 X |
| 3,333,597 | 8/1967 | Sullivan | 137/247.25 X |
| 3,422,835 | 1/1969 | Watts | 137/115.06 |
| 4,204,556 | 5/1980 | Sullivan | 137/247.25 X |
| 4,497,337 | 2/1985 | Mosbrucker et al. | 137/247.25 |
| 5,263,508 | 11/1993 | Perrott | 137/247.25 |
| 5,287,877 | 2/1994 | Ackroyd | 137/118.05 |

*Primary Examiner*—John Rivell

*Attorney, Agent, or Firm*—Hodgson, Russ, Andrews, Woods & Goodyear, LLP

[57] ABSTRACT

A trap seal primer valve for automatically charging water into a sewer line trap from a water line containing water under variable pressure.

23 Claims, 4 Drawing Sheets

PRESSURE-DROP ACTIVATED TRAP SEAL PRIMER VALVE

CROSS-REFERENCE TO RELATED APPLICATION

Applicant hereby claims priority based on Provisional Application No. 60/105,311 filed Oct. 23, 1998, and entitled "Pressure Drop Activated Trap Seal Primer Valve" which is incorporated herein by reference.

FIELD OF INVENTION

The present invention relates to a trap seal primer valve for providing a water charge to a sewer line water trap in response to a change in water line pressure.

BACKGROUND OF THE INVENTION

Trap seal primer valves are used for charging water into sewer line water traps to prevent the escape of sewer gases. Under normal conditions, the level of water in sewer line traps decreases through evaporation by about one-eighth of an inch for each twenty-four hour period. Accordingly, most municipal plumbing and sanitary codes require that means be provided for supplying water to the traps automatically or periodically to assure that the trap water level will be sufficiently high to render the trap operative and functional at all times.

To supply water to the traps automatically, it is usual to connect the trap to the house water line through a priming valve that is actuated by variations in pressure in the house line and acts to charge the trap with water upon each fluctuation of pressure in the house line. These primer valves are required to operate over long periods of time with minimum maintenance.

Many difficulties are associated with the use of conventional trap seal primers. Some of the primers require adjustment to the line pressure in order to function. Others require awkward adjustment to provide the desired metered amount of water. Also, some of the prior art units have an internal screen filter to contain calcium, iron, and other deposits that occur in municipal water supplies. When these filters become clogged, flow is constrained and disassembly of the trap seal primer may render it inoperable. Finally, moving parts in primers are subject to corrosion and failure, especially where springs are involved.

What is needed is a trap seal primer valve for sewer trap lines that does not require any special adjustment for line pressure or amount of water delivery, that dispenses a predictable amount of water in response to a minimal pressure drop (e.g., 3 lb.) occurring in the supply line, that will not flow continuously while the line is returning to normal pressure, that prevents backflow from the trap to the water line, that is simpler in construction and that has an easily replaceable mesh filter and cartridge.

SUMMARY OF THE INVENTION

The present invention meets the above-described need by providing a valve designed to discharge water into a sewer line trap from a water supply line containing water under variable pressures. The valve dispenses a charge of water whenever there is a fluctuation in the water line pressure such as when a faucet is opened.

The valve generally comprises a case having an inlet orifice, an exit orifice, and a chambered cartridge slidably disposed inside the case. The case has a longitudinal bore disposed there through. The inlet orifice is connected to the water line, and the exit orifice of the valve is connected to a sewer trap line. The case has pipe thread fittings on opposite ends for making the necessary plumbing connections.

The case also includes four external wrench flats at each end for assembling, disassembling, and installing the valve. A recessed groove at the inlet orifice provides for installing a fine, mesh filter. A high volume conical fine mesh filter fits into the recessed groove and can be removed and replaced without disassembling the valve.

The case divides into two sections by means of a set of female internal threads at the bottom end that receive a male threaded body end. The male threaded body end has a conical sealing seat disposed above the exit orifice.

A smaller internal bore at the top of the case provides a bearing guide for a cartridge assembly. The cartridge is contained in the longitudinal bore in the body of the device. The cartridge has an upper surface that provides a longitudinal bearing and a top seal. The cartridge is tubular with a partition located at various height positions that provide for various volumes of water discharge. The bottom surface of the cartridge provides a bearing surface for sliding the cartridge. The bottom surface also includes a conical seal for engaging with the conical sealing seat on the end portion.

A recessed groove disposed on the outside of the cartridge near the bottom surface provides an attachment point for a one-way cup seal. The flexible cup seal provides for flow into the lower portion of the case from the house water line, but does not allow backflow. The bottom of the cartridge also has a set of directional cross holes that provide for entry of water into the cartridge as described below.

The partition in the cartridge divides the cartridge into two chambers. The upper chamber is sealed, but the lower chamber has directional cross holes for flow of water into the chamber. When the valve is charge with pressurized water from the water line, the second chamber becomes a compressed air chamber.

At least three different models of the cartridge are contemplated with each model providing a different volume of water charge. By altering the position of the partition, three different volumes of air can be compressed in the lower portion of the cartridge tube.

In operation, the cartridge is slidably disposed inside the bore between a first position and a second position. In the first position, the exit orifice is blocked by engagement of the conical sealing seat with the conical seal on the lower surface of the cartridge. The conical seal engages with the sealing seat because the pressure from the water line on the top of the cartridge forces the lower surface of the cartridge downward into engagement with the conical sealing seat above the exit orifice. With the exit orifice blocked, water flows around the cartridge and into the second chamber of the cartridge until the pressure inside the second chamber reaches equilibrium with the water line pressure. Once this equilibrium position is reached the system remains in this state with no flow of water into the sewer trap line. The valve remains in this configuration until there is a pressure drop.

A pressure drop in the water line causes a pressure differential between the top of the cartridge and the inside of the second chamber such that the cartridge moves away from the exit orifice to allow a charge of water to be released into the sewer trap line. The top diameter of the cartridge is a larger diameter than the bottom cup seal area. Therefore, when the line pressure is imposed on the trap primer valve, a larger area top ensures that the hydraulic pressure differential between the smaller cup seal diameter and the larger top diameter provides a force to seal the conical tip. Next, the house line pressure builds back up and the pressure on the top of the cartridge again pushes the conical seal on the cartridge into engagement with the conical sealing seat to start the recharging process.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
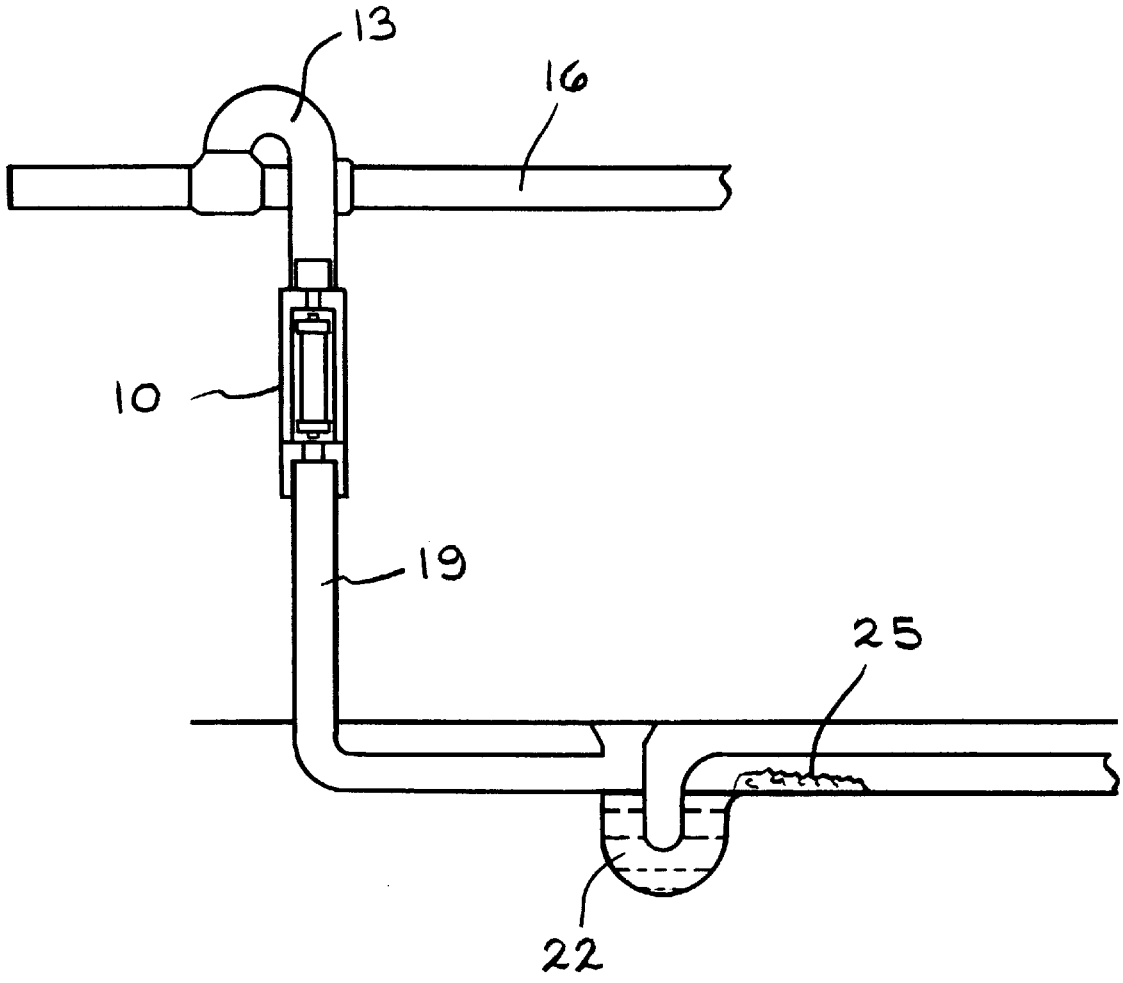
FIG. 1 is a schematic diagram illustrating the manner of installation of the trap seal primer valve of the present invention.

As shown in FIG. 1, the seal trap primer valve 10 of the present invention is adapted for insertion into a pressurized water line 13 that interconnects a water line 16 to the sewer trap lines 19. The function of the trap seal primer valve 10 is to keep the sewer trap 22 charged with water so that there is no possibility of the escape of sewer gas 25.

Figure 2:
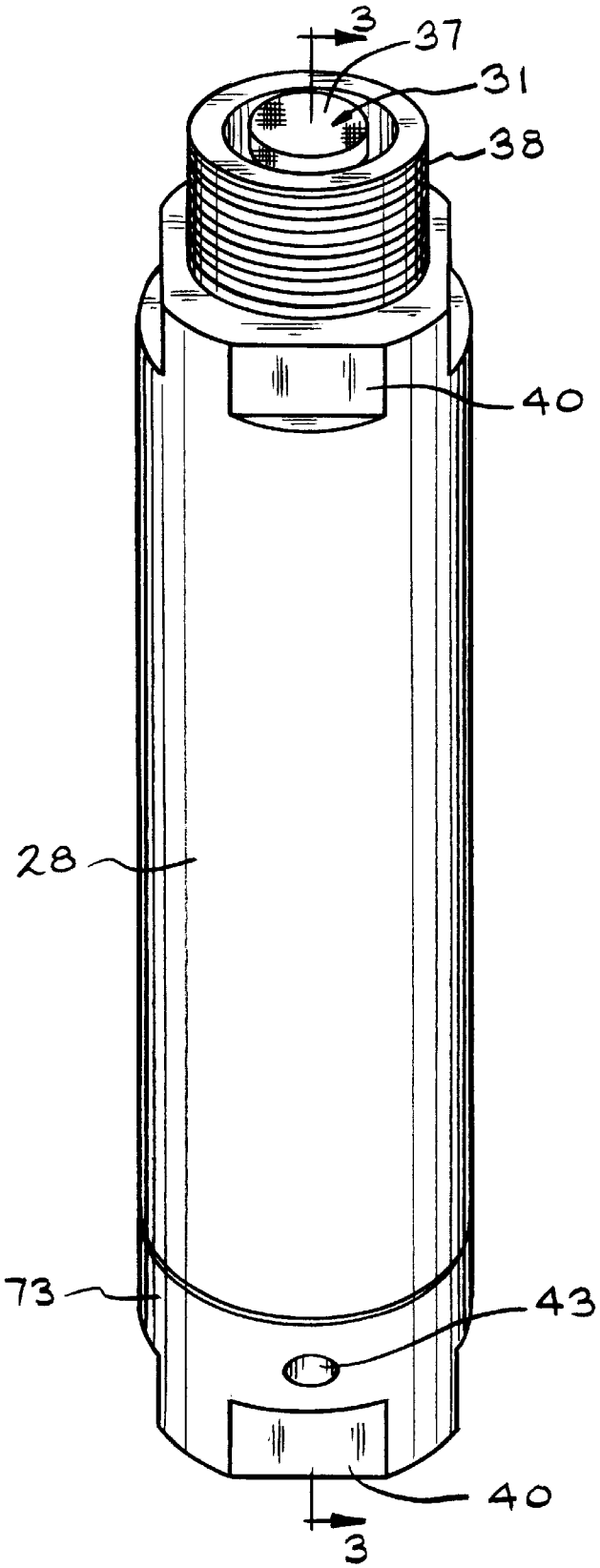
FIG. 2 is a perspective view of the trap seal primer valve of the present invention.

Turning to FIG. 2, the valve 10 is formed out of a cylindrical case 28. The cylindrical case has an inlet orifice 31 that is preferably equipped with a conical, fine mesh screen 37. The top of the case 28 has a set of male pipe threads 38 for connection to the pressurized water line 13. The water pressure from the water line 16 is approximately 60 psi, however, the valve 10 of the present invention can operate at other pressures. The typical operating range would be from about 20 to 80 psi.

Both the top and the bottom of the case 28 are equipped with four wrench flats 40. The wrench flats 40 provide for convenient assembly, disassembly and installation of the valve 10.

The downstream side of the valve 10 is equipped with vent openings 43. The vent/view openings 43 insure that the level of water in the sewer line trap is not disturbed by the development of a vacuum inside the sewer trap line 19.

Figure 3:
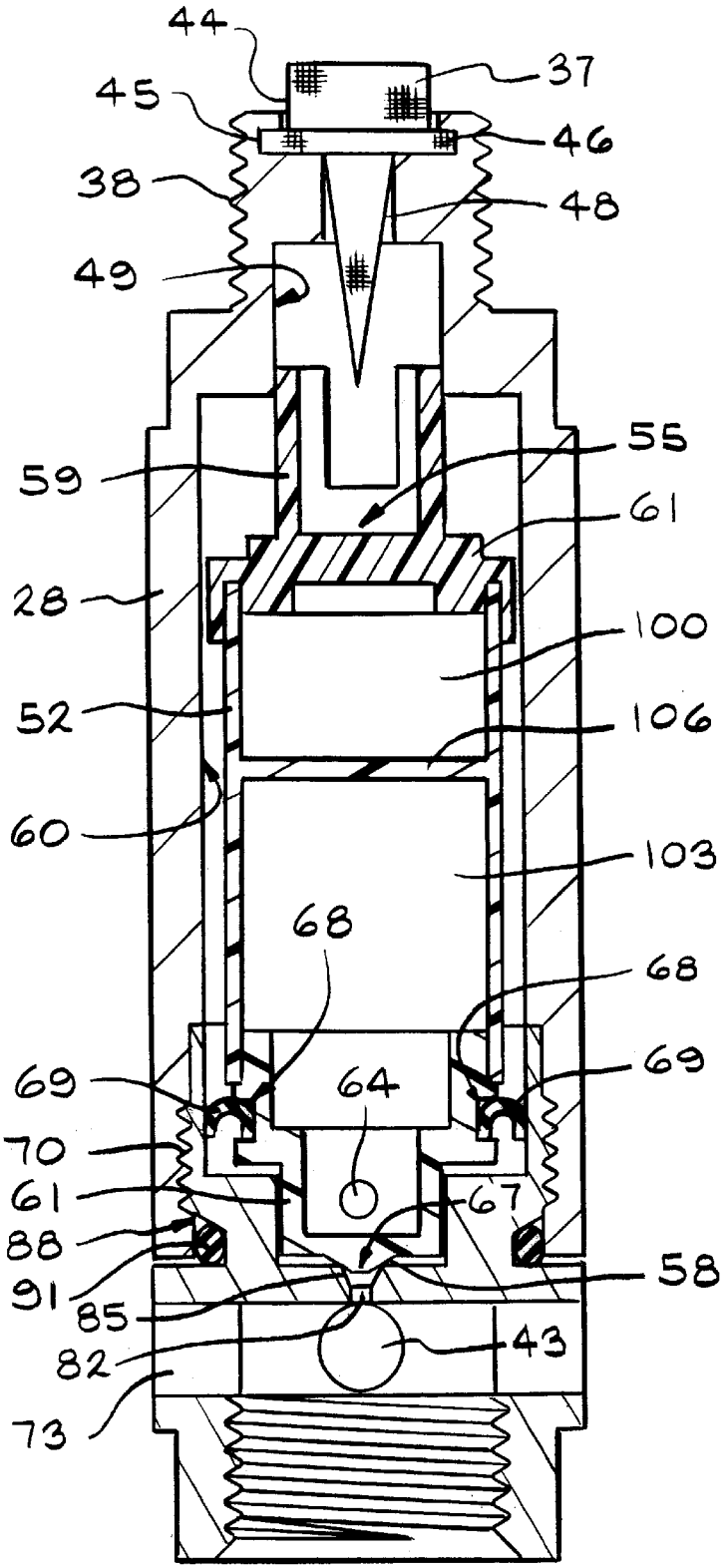
FIG. 3 is a cut away side elevation view of the trap seal primer valve with the cartridge in a first position where the cartridge shuts off water flow to the exit orifice; and, FIG. 4 is a cut-away side elevation view of the trap seal primer valve with the cartridge in a second position where the cartridge allows flow of water to the exit orifice.

In FIG. 3, the case 28 has screen 37 at the inlet end. The inlet end has a first cylindrical bore 44 having a first diameter. A second cylindrical bore 45 having a second diameter creates a recessed groove 46. A third cylindrical bore 48 has a third diameter. The screen 37 can be changed and/or removed by simply removing the valve 10 from the water line 13 and lifting the screen out of the recessed groove 46. The screen 37 is preferably a conical, fine mesh, high volume screen suitable for use with water at pressures from 20 to 80 psi.

The inside of the top portion of the case 28 has a cylindrical bore 49 having a diameter smaller than the diameter of the main bore 60. Bore 49 preferably provides a bearing surface for the top of a floating cartridge 52. The cartridge 52 is preferably cylindrical with a sealed top surface 55 and a sealed bottom surface 58. The top surface 55 has a reduced diameter extension 59 that engages with the bearing surface of bore 49 as the cartridge 52 slides up and down inside the case. The extension 59 is preferably formed with cylindrical side walls having rectangular portions removed therefrom. The outside of the cartridge 52 is spaced apart from bore 60. Cylindrical cartridge 52 has a round-shaped top 61 having a slot around its perimeter for receiving the top of the cartridge 52. The top 61 has side walls having an outside diameter that is slightly smaller than the diameter of the bore 60.

Toward the bottom of the case 28, the sidewall 61 of the cylindrical cartridge 52 has a plurality of cross-directional openings 64 disposed therein and located adjacent to the bottom surface 58. The bottom surface 58 preferably includes a cone-shaped seal 67. The cone-shaped seal 67 moves into and out of engagement with a conical sealing seat (described in greater detail below) to cut off fluid communication to the outlet of the case 28.

The lower end of the cartridge 52 has a groove 68 for mounting a one-way cup seal 69. The one-way cup seal 69 permits water to flow downward from the top of the case 28 to the bottom of the case 28, but does not allow water to pass upward. The lower end of the case 28 also has a set of internal female threads 70 that provide for attachment of an end portion 73. In this manner, the valve 10 can be opened by operation of the wrench flats on the bottom of the case 28 to provide for access to the inside of the valve 10 for replacing the cartridge 52.

The top diameter of the cartridge 52 has a larger diameter than the bottom cup seal 69 area. Therefore when the line pressure is imposed on the trap primer valve 10, a larger area top ensures that the hydraulic pressure differential between the smaller cup seal 69 diameter and the larger top diameter provides a force to seal the conical tip.

The end portion 73 has a pair of internal bores 76, 79 (best shown in FIG. 4); an exit orifice 82; and a cone shaped sealing seat 85 (best shown in FIG. 4) positioned above the exit orifice 82. The bore 76 mates with a lower section of the cartridge 52, and the bore 79 is a precision bore for engagement with the cup seal 69. The end portion 73 has a channel 88 for insertion of an O-ring 91 to seal the valve 10.

The cartridge 52 is divided into a first chamber 100 and a second chamber 103 by a partition 106. The first chamber 100 is completely sealed. The second chamber 106 provides an air compression chamber. The second chamber is open to the case 28 through the cross-directional openings 64 that are located around the perimeter of the cartridge 52. When the case 28 is being charged with water, the water flows around the cartridge 52 and into the second chamber 103 through the openings 64. The water inside the second chamber 103 compresses the air that resides in the chamber 103. By altering the position of the partition 106, a different volume of water charge can be obtained. Larger volume in the second chamber 103 produces greater volume water charges. Alternately, the second chamber 103 can be sized such that a partition and a first chamber 100 are not necessary. The purpose of the partition is to define the size of the second chamber.

In operation, the cartridge 52 is slidably disposed inside the bore between a first position and a second position. In the first position shown in FIG. 3, the exit orifice 82 is blocked by engagement of the conical sealing seat 85 with the conical seal 67 on the lower surface of the cartridge 52. The conical seal 67 engages with the sealing seat 85 because the pressure from the water line 13 on the top of the cartridge 52 forces the lower surface of the cartridge 52 downward into engagement with the conical sealing seat 85 above the exit orifice 82.

With the exit orifice 82 blocked, water flows around the cartridge 52, past the cup seal 69, and into the second chamber 103 of the cartridge 52 until the pressure inside the second chamber 103 reaches equilibrium with the water line 13 pressure. Once this equilibrium position is reached, the system remains in this state with no flow of water from the exit orifice 82 into the sewer trap line 19. The valve 10 remains in this configuration until there is a pressure drop.

Figure 4:
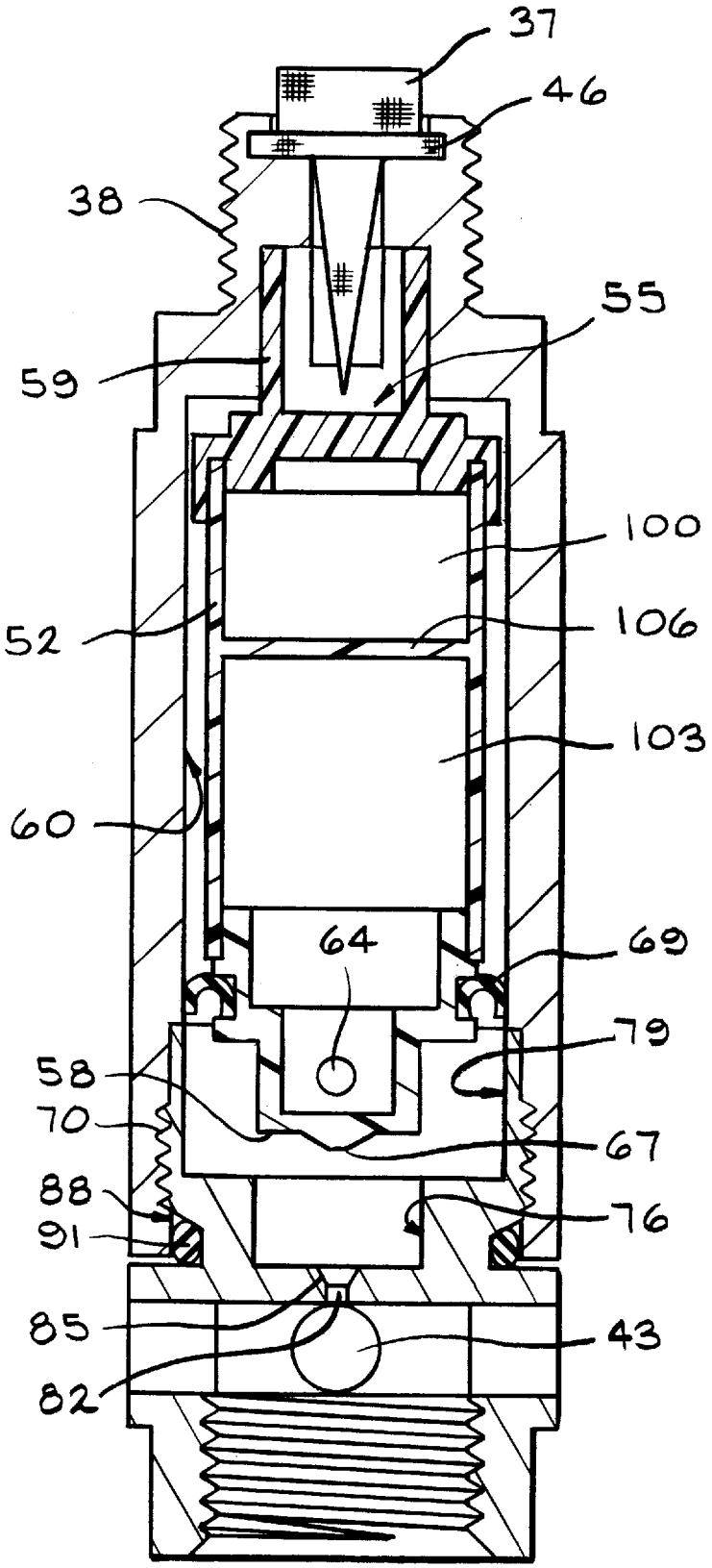

Referring to FIG. 4, a pressure drop in the water line 13 causes a pressure differential between the top of the cartridge 52 and the inside of the second chamber 106 such that the cartridge 52 moves away from the exit orifice 82 into the second position to allow a charge of water to be released into the sewer trap line 19. When the cartridge 52 moves upward to open the exit orifice 82, the area inside the case 28 below the cartridge 52 is exposed to atmospheric pressure due to communication with the vent/view openings 43 and therefore, the water flows into the sewer trap line 19.

Next, the house line 16 pressure builds back up and gradually, the pressure on the top of the cartridge 52 from line 13 again pushes the cartridge 52 downward such that the conical seal 67 engages with the conical sealing seat 85 to start the recharging process.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A valve for charging water into a sewer line trap from a water line containing water under variable pressure, the valve comprising:

a) a case having a bore disposed longitudinally there through, the case having an inlet orifice and an outlet orifice; and, b) a cartridge having a top surface disposed adjacent to the inlet orifice, a bottom surface capable of engaging with and closing the outlet orifice, and a chamber, the chamber having at least one aperture disposed therein, the cartridge slidably disposed inside the bore between a first position where water pressure from the water line on the top of the cartridge forces the lower surface of the cartridge to close the exit orifice such that water flows around the cartridge and into the chamber and a second position where a pressure drop in the water line causes a pressure differential between the top of the cartridge and the inside of the chamber such that the cartridge moves away from the exit orifice to allow a charge of water to be released into the sewer trap line.

2. The valve of claim 1, wherein the chamber further comprises a first chamber and a second chamber divided by a partition.

3. The valve of claim 1, wherein the case further comprises an end portion.

4. The valve of claim 3, wherein the case has a set of internal threads capable of mating with an end portion.

5. The valve of claim 1, where the case has a set of wrench flats.

6. The valve of claim 1, further comprising a one-way valve disposed inside the case and around the cartridge such that water from the water line flows around the cartridge through the valve.

7. The valve of claim 1, further comprising a mesh filter disposed adjacent to the inlet orifice.

8. The valve of claim 7, wherein the mesh filter is conical.

9. The valve of claim 7, wherein the filter is removable.

10. The valve of claim 2, wherein the location of the partition determines the volume of water charge.

11. A valve for changing water into a sewer line trap from a water line under variable pressure, the valve comprising:

a) a case having a bore disposed longitudinally there through, the case having an inlet orifice at one end and an opening having a set of internal threads at the opposite end;

b) an end portion having a set of threads capable of engaging with the threads on the case and having an exit orifice; and, c) a cartridge having a top surface disposed adjacent to the inlet orifice, a bottom surface capable of engaging with and closing the outlet orifice, and a partition dividing the cartridge into a first chamber and a second chamber, the second chamber having at least one aperture disposed therein, the cartridge slidably disposed inside the bore between a first position where water pressure from the water line on the top of the cartridge forces the lower surface of the cartridge to close the exit orifice such that water flows around the cartridge and into the second chamber and a second position where a pressure drop in the water line causes a pressure differential between the top of the cartridge and the inside of the second chamber such that the cartridge moves away from the exit orifice to allow a charge of water to be released into the sewer trap line.

12. The valve of claim 11, where the case has a set of wrench flats.

13. The valve of claim 11, further comprising a one-way valve disposed inside the case and around the cartridge such that water from the water line flows around the cartridge through the valve.

14. The valve of claim 11, further comprising a mesh filter disposed adjacent to the inlet orifice.

15. The valve of claim 14, wherein the mesh filter is conical.

16. The valve of claim 14, wherein the filter is removable.

17. The valve of claim 11, wherein the location of the partition determines the volume of water charge.

18. A valve for charging water into a sewer line trap from a water line under variable pressure, the valve comprising:

a) a case having a bore disposed longitudinally there through, the case having an inlet orifice at one end and an opening having a set of internal threads at the opposite end, the case having wrench flats on the outside;

b) a removable filter disposed adjacent to the inlet orifice;

c) an end portion having a set of threads capable of engaging with the threads on the case and having an exit orifice;

d) a cartridge having a top surface disposed adjacent to the inlet orifice, a bottom surface capable of engaging with and closing the outlet orifice, and a partition dividing the cartridge into a first chamber and a second chamber, the second chamber having at least one aperture disposed therein, the cartridge slidably disposed inside the bore between a first position where water pressure from the water line on the top of the cartridge forces the lower surface of the cartridge to close the exit orifice such that water flows around the cartridge and into the second chamber and a second position where a pressure drop in the water line causes a pressure differential between the top of the cartridge and the inside of the second chamber such that the cartridge moves away from the exit orifice to allow a charge of water to be released into the sewer trap line; and, e) a one-way valve disposed between the cartridge and the case such that water flows around the cartridge through the valve.

19. The valve of claim 18, wherein the location of the partition determines the volume of water charge.

20. The valve of claim 18, wherein the cartridge has an extension that engages with a bearing surface in the case.

21. The valve of claim 18, further comprising holes disposed in the end portion.

22. The valve of claim 18, wherein the one-way valve is a cup seal.

23. A method for charging water into a sewer line trap from a water line containing water under variable pressure, the method comprising the steps of:

a) providing a valve having a case having a bore disposed longitudinally there through, the case having an inlet orifice and an outlet orifice; and, a cartridge having a top surface disposed adjacent to the inlet orifice, a bottom surface capable of engaging with and closing the outlet orifice, and a partition dividing the cartridge into a first chamber and a second chamber, the second chamber having at least one aperture disposed therein, the cartridge slidably disposed inside the bore between a first position where water pressure from the water line on the top of the cartridge forces the lower surface of the cartridge to close the exit orifice such that water flows around the cartridge and into the second chamber and a second position where a pressure drop in the water line causes a pressure differential between the top of the cartridge and the inside of the second chamber such that the cartridge moves away from the exit orifice to allow a charge of water to be released into the sewer trap line;

b) connecting the valve between the water line and the sewer line trap; and, c) varying the pressure in the water line to cause a charge of water to be discharged from the valve into the sewer line trap.

* * * * *